US008778584B2

(12) United States Patent
Mang et al.

(10) Patent No.: US 8,778,584 B2
(45) Date of Patent: Jul. 15, 2014

(54) TONER COMPOSITIONS

(75) Inventors: Mark E. Mang, Rochester, NY (US); Grazyna Kmiecik-Lawrynowicz, Fairport, NY (US); Maura A. Sweeney, Irondequoit, NY (US); Timothy L. Lincoln, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 411 days.

(21) Appl. No.: 12/579,687

(22) Filed: Oct. 15, 2009

(65) Prior Publication Data

US 2011/0091801 A1 Apr. 21, 2011

(51) Int. Cl.
*G03G 9/087* (2006.01)

(52) U.S. Cl.
USPC ..... 430/108.2; 430/108.8; 430/108.4; 430/137.14

(58) Field of Classification Search
USPC ..... 430/108.8, 108.2, 108.4
See application file for complete search history.

(56) References Cited

U.S. PATENT DOCUMENTS

| | | | | |
|---|---|---|---|---|
| 2,874,063 | A | 2/1959 | Greig | |
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,265,990 | A | 5/1981 | Stolka et al. | |
| 4,298,672 | A | 11/1981 | Lu | |
| 4,338,390 | A | 7/1982 | Lu | |
| 4,563,408 | A | 1/1986 | Lin et al. | |
| 4,584,253 | A | 4/1986 | Lin et al. | |
| 4,935,326 | A | 6/1990 | Creatura et al. | |
| 4,937,166 | A | 6/1990 | Creatura et al. | |
| 5,227,460 | A | 7/1993 | Mahabadi et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,853,943 | A | 12/1998 | Cheng et al. | |
| 6,004,714 | A | 12/1999 | Ciccarelli et al. | |
| 6,190,815 | B1 | 2/2001 | Cirrarelli et al. | |
| 7,037,633 | B2 | 5/2006 | Hopper et al. | |
| 7,217,484 | B2 | 5/2007 | Marcello et al. | |
| 7,344,813 | B2 | 3/2008 | Sweeney et al. | |
| 2008/0153025 | A1 * | 6/2008 | Lai et al. | 430/109.3 |
| 2008/0166648 | A1 | 7/2008 | Veregin et al. | |
| 2008/0247788 | A1 * | 10/2008 | Ayaki et al. | 399/321 |
| 2011/0086304 | A1 * | 4/2011 | Asarese et al. | 430/107.1 |

OTHER PUBLICATIONS

WO 2008/157436, Bosnyak C et al, Dec. 24, 2008.*

* cited by examiner

*Primary Examiner* — Mark F Huff
*Assistant Examiner* — Rachel Zhang
(74) *Attorney, Agent, or Firm* — MDIP LLC

(57) ABSTRACT

The present disclosure provides toners and methods for their production. In embodiments, the amount of coagulant utilized in producing those toners may be less than amounts currently in use, which may have a beneficial effect by reducing the time for coalescence. Modified waxes may also be utilized which provide excellent gloss and charging characteristics.

11 Claims, 6 Drawing Sheets

| PARAFFIN WAX | Normal | Isomers |
|---|---|---|
| TOTAL | 86.856 | 13.144 |
| Mn | 518 | 560 |
| Mw | 524 | 565 |
| Mz | 530 | 570 |
| SKEWNESS | 1.706 | 1.849 |
| KURTOSIS | 1.588 | 2.058 |

TONER COMPOSITIONS

BACKGROUND

The present disclosure relates to toners and processes useful in providing toners suitable for electrostatographic apparatuses, including xerographic apparatuses such as digital, image-on-image, and similar apparatuses.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Some high gloss EA toners use resins possessing a core-shell configuration, with a lower glass transition temperature (Tg) resin in the core and a higher Tg resin in the shell. Such toners may include waxes and may be produced with aggregating agents based on aluminum. Processes for producing such toners may utilize sequestering agents to remove aluminum ions and lower ionic cross-linking, thereby increasing the gloss. One issue with these toners is they may be prone to blocking issues and may have many wax protrusions on the surface.

Improved methods for producing toner, which decrease the production time and permit excellent control of the charging of toner particles, remain desirable.

SUMMARY

The present disclosure provides toners and methods for their production. In embodiments, a toner of the present disclosure may include a resin, an optional colorant, and a modified paraffin wax possessing branched carbons in combination with linear carbons, wherein the branched carbons are present in an amount of from about 1% to about 20% of the wax and have a number average molecular weight of from about 520 to about 600, and the linear carbons are present in an amount of from about 80% to about 99% of the wax and have a number average molecular weight of from about 505 to about 530.

In other embodiments, a toner of the present disclosure may include a resin including styrenes, acrylates, methacrylates, butadienes, isoprenes, acrylic acids, methacrylic acids, acrylonitriles, and combinations thereof, an optional colorant, and a modified paraffin wax possessing branched carbons in combination with linear carbons, wherein the branched carbons are present in an amount of from about 1% to about 20% of the wax and have a number average molecular weight of from about 520 to about 600, and the linear carbons are present in an amount of from about 80% to about 99% of the wax and have a number average molecular weight of from about 505 to about 530, and wherein particles comprising the toner possess a circularity of from about 0.982 to about 0.995.

A process of the present disclosure may include contacting an emulsion including at least one resin with a modified paraffin wax and an optional colorant; aggregating the particles by contacting the particles with from about 0.1 parts per hundred to about 0.18 parts per hundred of an aggregating agent such as aluminum sulfate, polyaluminum chloride, polyaluminum bromide, polyaluminum fluoride, polyaluminum iodide, polyaluminum silicate, polyaluminum sulfosilicate, aluminum chloride, aluminum nitrite, aluminum sulfate, potassium aluminum sulfate, and combinations thereof to form aggregated particles; coalescing the aggregated particles for a period of time of from about 1 hour to about 3 hours minutes to form toner particles; and recovering the toner particles, wherein the toner particles possess a circularity of from about 0.982 to about 0.995.

BRIEF DESCRIPTION OF THE DRAWINGS

Various embodiments of the present disclosure will be described herein below with reference to the figure wherein.

DETAILED DESCRIPTION OF EMBODIMENTS

Figure 1:
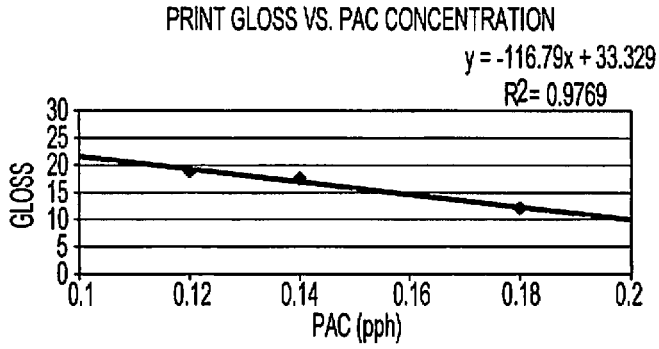
FIG. 1 is a graph depicting measured print gloss for toners of the present disclosure with different levels of polyaluminum chloride (PAC)

The present disclosure provides toners and processes for the preparation of toner particles having excellent gloss properties. Toners of the present disclosure may be prepared under conditions which optimize gloss while reducing preparation time.

In embodiments, toners of the present disclosure may be prepared by combining a latex polymer, a wax, an optional colorant, and other optional additives. While the latex polymer may be prepared by any method within the purview of those skilled in the art, in embodiments the latex polymer may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 microns to about 15 microns.

Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex polymer. The glass transition temperature of this latex, which in embodiments may be used to form a toner of the present disclosure, may be from about 35° C. to about 75° C., in embodiments from about 40° C. to about 60° C.

Surfactants

In embodiments, the latex may be prepared in an aqueous phase containing a surfactant or co-surfactant. Surfactants which may be utilized with the polymer to form a latex dispersion can be ionic or nonionic surfactants in an amount to provide a dispersion of from about 10 to about 60 weight percent solids, in embodiments of from about 30 to about 50 weight percent solids. The latex dispersion thus formed may be then charged into a reactor for aggregation and the formation of toner particles.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methylpropionamidine] dihydrochloride, 2,2'-azobis[N-(4-amino-phenyl)-2-methylpropionamidine]tetrahydrochloride, 2,2'-azobis[2-methyl-N (phenylmethyl)propionamidine]dihydrochloride, 2,2'-azobis [2-methyl-N-2-propenylpropionamidine]dihydrochloride, 2,2'-azobis[N-(2-hydroxy-ethyl)-2-methylpropionamidine] dihydrochloride, 2,2'-azobis[2(5-methyl-2-imidazolin-2-yl) propane]dihydrochloride, 2,2'-azobis[2-(2-imidazolin-2-yl) propane]dihydrochloride, 2,2'-azobis[2-(4,5,6,7-tetrahydro-1H-1,3-diazepin-2-yl)propane]dihydrochloride, 2,2'-azobis [2-(3,4,5,6-tetrahydropyrimidin-2-yl)propane] dihydrochloride, 2,2'-azobis[2-(5-hydroxy-3,4,5,6-tetrahydropyrimidin-2-yl)propane]dihydrochloride, 2,2'-azobis{2-[1-(2-hydroxyethyl)-2-imidazolin-2-yl] propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

Stabilizers

In embodiments, it may be advantageous to include a stabilizer when forming the latex polymer and the particles making up the polymer. Suitable stabilizers include monomers having carboxylic acid functionality. Such stabilizers may be of the following formula (I):

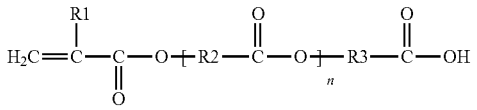

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer are carbonates including sodium carbonate, sodium bicarbonate, calcium carbonate, potassium carbonate, ammonium carbonate, combinations thereof, and the like. In other embodiments, a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax

Wax dispersions may also be added during formation of a latex polymer in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

In embodiments, a suitable wax may include a paraffin wax. Suitable paraffin waxes include, for example, paraffin waxes possessing modified crystalline structures, which may be referred to herein, in embodiments, as a modified paraffin wax. Thus, compared with conventional paraffin waxes, which may have a symmetrical distribution of linear carbons and branched carbons, the modified paraffin waxes of the present disclosure may possess branched carbons in an amount of from about 1% to about 20% of the wax, in embodiments from about 8% to about 16% of the wax, with linear carbons present in an in amount of from about 80% to about 99% of the wax, in embodiments from about 84% to about 92% of the wax.

In addition, the isomers, i.e., branched carbons, present in such modified paraffin waxes may have a number average molecular weight (Mn), of from about 520 to about 600, in embodiments from about 550 to about 570, in embodiments about 560. The linear carbons, sometimes referred to herein, in embodiments, as normals, present in such waxes may have a Mn of from about 505 to about 530, in embodiments from about 512 to about 525, in embodiments about 518. The weight average molecular weight (Mw) of the branched carbons in the modified paraffin waxes may be from about 530 to about 580, in embodiments from about 555 to about 575, and the Mw of the linear carbons in the modified paraffin waxes may be from about 480 to about 550, in embodiments from about 515 to about 535.

For the branched carbons, the weight average molecular weight (Mw) of the modified paraffin waxes may demonstrate a number of carbon atoms of from about 31 to about 59 carbon atoms, in embodiments from about 34 to about 50 carbon atoms, with a peak at about 41 carbon atoms, and for the linear carbons, the Mw may demonstrate a number of carbon atoms of from about 24 to about 54 carbon atoms, in embodiments from about 30 to about 50 carbon atoms, with a peak at about 36 carbon atoms.

The modified paraffin wax may be present in an amount of from about 3% by weight to about 15% by weight of the toner, in embodiments from about from about 6% by weight to about 10% by weight of the toner, in embodiments about 8% by weight of the toner.

Colorants

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido)phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 (sometimes referred to herein, in embodiments, as PB 15:3 cyan pigment) having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade.

Reaction Conditions

In the emulsion aggregation process, the reactants may be added to a suitable reactor, such as a mixing vessel. The appropriate amount of latex resin, surfactant(s), wax, colorant, if any, and the like, may be combined in the reactor and the emulsion aggregation process may be allowed to begin. Reaction conditions selected for effecting the emulsion aggregation include temperatures of, for example, from about 45° C. to about 90° C., in embodiments from about 47.5° C. to about 60° C.

Aggregating Agents

In embodiments, an aggregating agent may be added during or prior to aggregating the latex, wax, optional additives, and the aqueous colorant dispersion. The aggregating agent may be added over a period of time from about 1 minute to about 60 minutes, in embodiments from about 1.25 minutes to about 20 minutes, depending on the processing conditions.

Examples of suitable aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof; and the like. In embodiments, suitable aggregating agents include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid.

In embodiments, a suitable aggregating agent includes PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

Surprisingly, in accordance with the present disclosure, it has been found that lower amounts of an aggregating agent such as PAC may reduce the time required for aggregation. Thus, suitable amounts of aggregating agent may be from about 0.01 parts per hundred (pph) to about 22 pph, in embodiments from about 0.1 pph to about 0.18 pph, The resulting blend of latex, optionally in a dispersion, optional colorant dispersion, wax, and aggregating agent, may then be stirred and heated to a temperature around the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 3 microns to about 15 microns in volume average diameter, in embodiments of from about 4 microns to about 8 microns in volume average diameter.

In embodiments, while not required, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex with the addition of the shell latex once aggregated particles have formed.

In other embodiments, toner particles of the present disclosure may not include a separate shell.

Once the desired final size of the toner particles is achieved, the pH of the mixture may be adjusted with a base to a value of from about 3.5 to about 7, in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, optional colorant, and wax may be subsequently coalesced. Coalescing may include stirring and heating at a temperature of from about 80° C. to about 99° C., in embodiments from about 85° C. to about 98° C., for a period of from about 15 minutes to about 6 hours, and in embodiments from about 30 minutes to about 5 hours.

In some embodiments, lower amounts of an aggregating agent such as PAC may reduce the time for coalescence by up to about 50%, with time for coalescence being from about 0.5 hours to about 5 hours, in embodiments from about 1 hour to about 3 hours. For example, in some embodiments, use of about 0.12 pph of an aggregating agent such as PAC may result in an coalescence time of about 1.25 hours.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, in embodiments from about 1 to about 20 percent by weight of the mixture.

The mixture may then be cooled in a cooling or freezing step. Cooling may be at a temperature of from about 20° C. to about 40° C., in embodiments from about 22° C. to about 30° C., over a period of time from about 1 hour to about 8 hours, in embodiments from about 1.5 hours to about 5 hours.

In embodiments, cooling a coalesced toner slurry may be performed by lowering the jacket temperature of the reactor. Alternate methods may include quenching by adding a cooling medium such as, for example, ice, dry ice and the like, to effect rapid cooling to a temperature of from about 20° C. to about 40° C., in embodiments of from about 22° C. to about 30° C.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and reslurrying a filter cake including toner particles in deionized water (DI water). The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

Toners of the present disclosure may have a gloss as measured in Gardner gloss units (ggu) of from about 10 to about 30, in embodiments from about 15 to about 25 measured on Xerox 4200 paper.

Additives

Further optional additives which may be combined with a toner include any additive to enhance the properties of toner compositions. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E88™, zinc salts such as BONTRON E84™ (Orient Chemical); combinations thereof, and the like.

Other additives which may be combined with a toner composition of the present disclosure include surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.01 to about 10 weight percent of the toner, in embodiments from about 0.05 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.01 to about 5 percent by weight of the toner, in embodiments from about 0.05 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.982 to about 0.995, in embodiments from about 0.984 to about 0.990. Circularity may be measured on a Sysmex 3000 particle analyzer.

Following the methods of the present disclosure, toner particles may be obtained having several advantages compared with conventional toners: (1) increase in the robustness of the particles' flowability and cleaning, in part, to reduced wax at the surface of the particles, which reduces toner defects and improves machine performance; (2) easy to implement, no major changes to existing aggregation/coalescence processes; and (3) increase in productivity and reduction in unit manufacturing cost (UMC) by reducing the production time and the need for rework (quality yield improvement).

Utilizing the methods of the present disclosure, one may be able to obtain toner particles by EA processes having smoothness and circularity obtained by other conventional processes. For example, a suspension process is used by some manufacturers to form a wax core with a resin as a shell around the wax. The suspension process produces inherently smooth, highly circular particles. The present disclosure provides smooth particles by way of an EA process, the particles having wax in the interior of the particle, high circularity, and at a reduced manufacturing time relative to other conventional EA processes.

Uses

Toners in accordance with the present disclosure can be used in a variety of imaging devices including printers, copy machines, and the like. The toners generated in accordance with the present disclosure are excellent for imaging processes, especially xerographic processes, and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Toners were prepared using a 2 liter glass reactor. The formulations were the same, except for the amount of PAC added. The general formulation is summarized below in Table 1. Water was added so that the reactor had a solids content of about 14%.

TABLE 1

| Raw Material | Weight % of solids | grams |
|---|---|---|
| DI Water | | 778.2 |
| Carbon Black | 5 | |
| Cyan Pigment | 1 | |
| Styrene/Acrylate Latex | 61 | |
| Styrene/Acrylate Latex | 28 | |
| Paraffin Wax | 5 | |
| Items not part of solids calculation | | |
| PAC | 0.12, 0.14, or 0.18 pph | |
| Acid for PAC | 27, 31.5 or 40.5 g 0.02M HNO3 | |
| Freeze pH | 4.7 | |
| Shape control pH @ 90 C. | 4 | |

Figure 2:
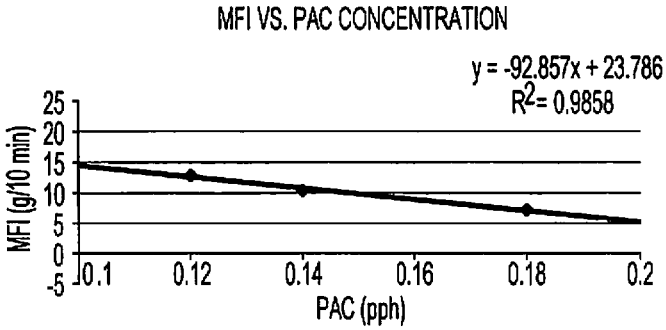
FIG. 2 is a graph depicting melt flow index (MFI) for toners of the present disclosure with different levels of PAC.

The levels of PAC were 0.18 pph (nominal), 0.14 pph, and 0.12 pph. The lower amounts of PAC addition had no adverse effect on the aggregation process. The toners had external additives, silicon oxide which were applied via a Fujimill blender. After blending, the toners were inserted into a commercially available 8 parts per million (ppm) color, 12 ppm black printer and fused prints were made. FIG. 1 shows how the gloss level of the prints increased as the PAC level decreased. FIG. 2 shows MFI, or melt flow index data, as a function of PAC addition level. (MFI is a measure of the toner's flowability.) As can be seen in FIG. 2, the MFI values increased as the PAC levels decreased. The increased flowability thus caused the higher gloss.

Figure 3:
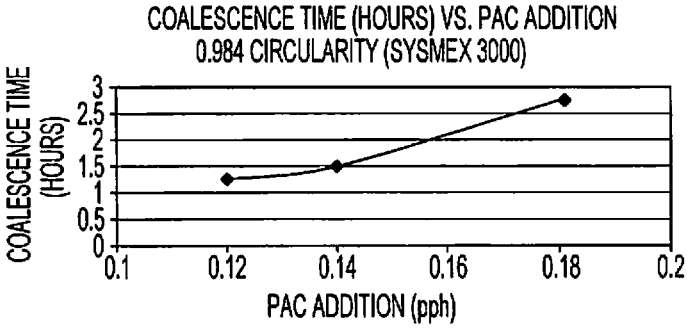
FIG. 3 is a graph depicting reduced coalescence time as a function of PAC addition for toners of the present disclosure.

During the production of the EA toner there was an aggregation step where the raw materials were introduced to a flocculent, like PAC. The raw materials were heated to a temperature around the resin Tg (glass transition temperature) and formed into aggregates. When the proper size was achieved, the pH was raised with the addition of base to freeze the particle size. After this step, the temperature was increased to allow the individual particles to melt and fuse together to became a single particle. The same coalescence pH and temperature profile were used for all three toners. A surprising effect of the reduced PAC levels was the marked improvement in coalescence time, which is shown in FIG. 3. A reduction in time of coalescence of nearly 50% was observed with lower amounts of PAC. This reduced the overall cycle time to make the toner, which is a benefit for manufacturing.

The desired circularity was >=0.984 as measured on a Sysmex 3000.

TEM and SEM images were taken of both toners produced in accordance with the present disclosure and commercially available toners, which used a polyethylene or polymethylene wax. These waxes tended to form platelets near the surface of the toner, which prevented the toner from having a uniformly smooth surface. In some cases these particles had surfaces with exposed wax.

To the contrary, the toner of the present disclosure possessed a modified paraffin wax as described above which migrated toward the center of the toner during processing. Thus, toners of the present disclosure possessed distinct domains of wax in the interior of the particle and a uniformly smooth toner surface.

Figure 4:
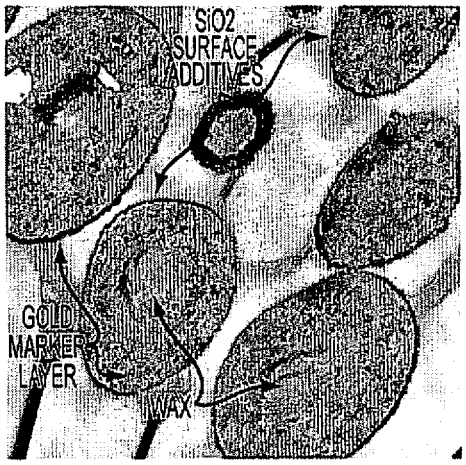
FIG. 4 is a transmission electron microscope (TEM) picture of a commercially available toner showing wax in the toner's interior.
Figure 5:
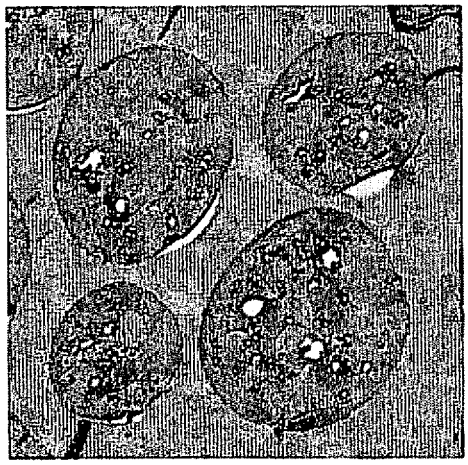
FIG. 5 is a TEM picture of an EA toner of the present disclosure with paraffin wax domains in the toner interior.
Figure 6:
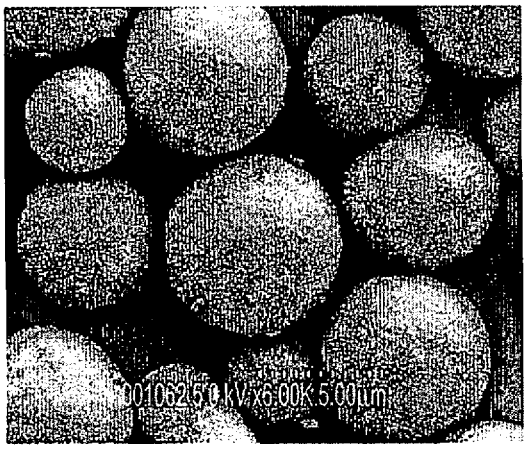
FIG. 6 is a scanning electron microscope (SEM) picture of a commercially available toner with a smooth surface (particles on surface were external additives added by dry blending)
Figure 7:
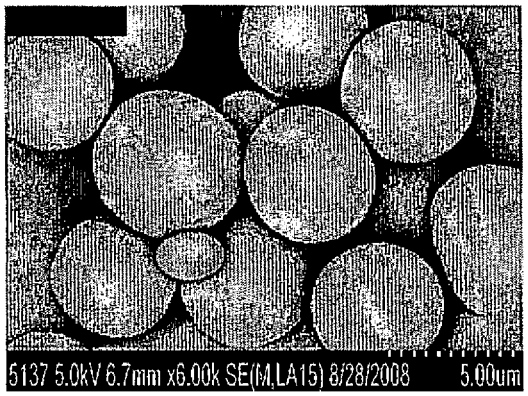
FIG. 7 is a SEM picture of a toner of the present disclosure having a smooth surface, free of wax protrusions.
Figure 8:
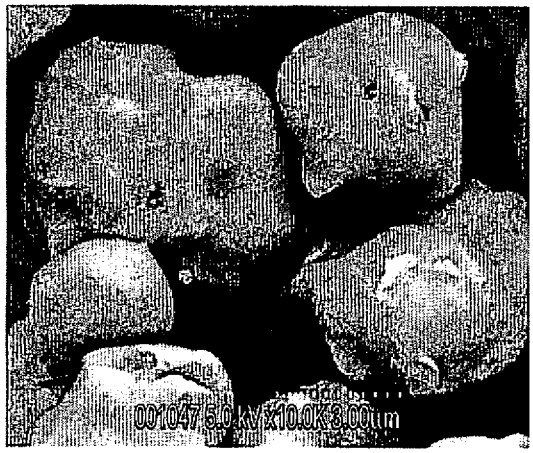
FIG. 8 is a SEM picture of an EA toner made with non-paraffin wax (notice the tendency of the wax to migrate toward the surface and form wax protrusions)
Figure 9:
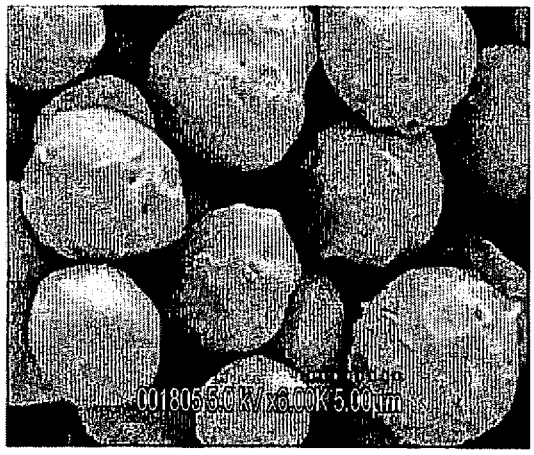
FIG. 9 is a SEM picture of an EA toner similar to that shown in FIG. 7, except a non-paraffin type wax was used.

FIG. 4 is a TEM cross-section of the control toner made via suspension process. The resin was thus "grown" around a core of wax. FIG. 5 shows the TEM cross section of a toner of the present disclosure made using the modified paraffin wax. FIG. 6 is a SEM image showing the smooth surface of the control toner. The small particles on the surface were external additives that were dry blended onto the surface. FIG. 7 is a SEM image showing the EA toner of the present disclosure with a very smooth surface free of wax protrusions. FIG. 8 shows a SEM picture of the parent particle prior to the addition of the external flow and charging agents. The toner shown in FIG. 8 was made with a Fisher Tropsch wax (non-paraffin type). As can be seen in FIG. 8, the wax migrated toward the surface and formed wax protrusions on the toner surface. FIG. 9 shows a toner similar to that of FIG. 7, with the non-paraffin wax instead of paraffin wax. Again, the toner shown in FIG. 7 with the modified paraffin wax was more similar in appearance to the control toner than with the toner possessing the non-paraffin wax shown in FIG. 9.

Figure 10:
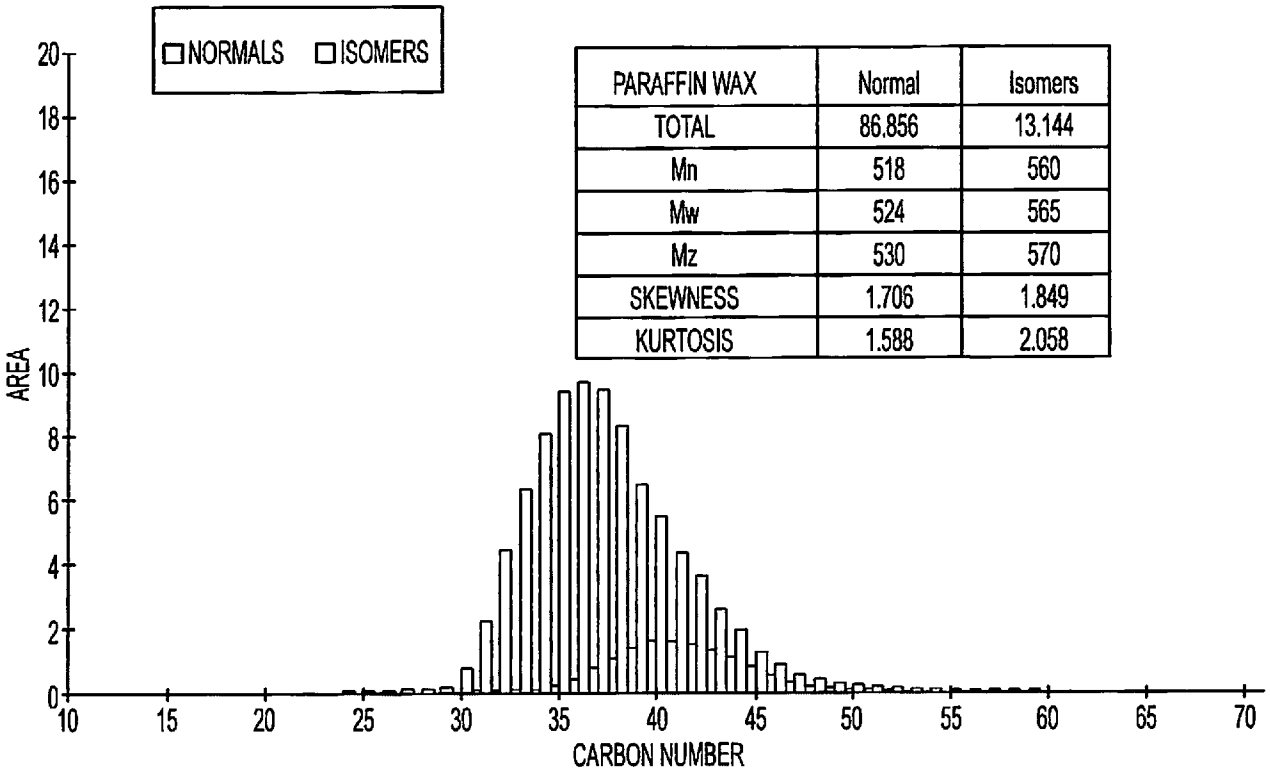
FIG. 10 is a graph of the results of high temperature gas chromatography mass spectrometry (GCMS) analysis of a wax suitable for use in accordance with the present disclosure, having a modified crystalline structure.

Analysis of the modified paraffin wax, was conducted by high temperature GCMS. FIG. 10 shows the results of the high temperature GCMS analysis. As can be seen in FIG. 10, the wax had a different distribution for the normal (linear) and isomer (branched) molecules. The Mn of the normals was 518 and the Mn of the isomers was 560. Additionally, the Mw distribution demonstrated a peak Mw at C41 for the isomers and C36 for the normals. This resulted in optimized modification of the wax viscosity, and allowed the wax to migrate toward the center of the toner particle and away from the toner surface.

NMR analysis was conducted on the modified paraffin wax. Table 2 shows the results of the NMR analysis, which revealed 7 branches per 100 chains of carbon in the wax, with 3 of the 7 branches adjacent to the chain end. Without wishing to be bound by any theory, it is believed this design provided the unique properties that enabled the wax to remain in the toner.

TABLE 2

NMR analysis of paraffin wax

| Sample | $M_n$ (by NMR) | # Isolated Long Branches per 100 Chains | # Methyl Branches per 100 Chains | # Pendant-OH groups per 100 Chains |
|---|---|---|---|---|
| Modified Paraffin Wax | 710 | 0 | 7 (3 out of 7 were located next to the chain ends) | 0 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An emulsion aggregation toner comprising:

a resin, an optional colorant, and a modified paraffin wax comprising branched isomers and linear isomers, wherein the branched isomers are present in an amount of from about 1% to about 20% of the wax and have a number average molecular weight of from about 520 to about 600, and the linear isomers are present in an amount of from about 80% to about 99% of the wax and have a number average molecular weight of from about 505 to about 530, and wherein the toner is free of wax protrusions on the toner surface.

2. The toner of claim 1, wherein the resin is selected from the group consisting of styrenes, acrylates, methacrylates, butadienes, isoprenes, acrylic acids, methacrylic acids, acrylonitriles, and combinations thereof.

3. The toner of claim 1, wherein the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate isoprene), poly(methyl acrylate-isoprene), poly(ethyl acrylate-isoprene), poly(propyl acrylate-isoprene), poly(butyl acrylate-isoprene), poly(styrene-butyl acrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

4. The toner of claim 1, wherein the optional colorant comprises dyes, pigments, combinations of dyes, combinations of pigments, and combinations of dyes and pigments, and wherein the toner further comprises at least one stabilizer selected from the group consisting of acrylic acid, beta carboxyethyl acrylate, poly(2-carboxyethyl)acrylate, 2-carboxyethyl methacrylate, or combinations thereof.

5. The toner of claim 1, wherein the branched isomers in the modified paraffin wax have a weight average molecular weight of from about 530 to about 580, and the linear isomers in the modified paraffin wax have a weight average molecular weight of from about 480 to about 550.

6. The toner of claim 1, wherein the branched isomers of the modified paraffin wax have a number of carbon atoms of from about 31 to about 59, and the linear isomers of the modified paraffin wax have a number of carbon atoms of from about 24 to about 54.

7. The toner of claim 1, wherein the toner possesses a size of from about 1 micron to about 20 microns.

8. The toner of claim 1, wherein the toner possesses a circularity of from about 0.982 to about 0.995.

9. An emulsion aggregation toner comprising:

a resin selected from the group consisting of styrenes, acrylates, methacrylates, butadienes, isoprenes, acrylic acids, methacrylic acids, acrylonitriles, and combinations thereof, an optional colorant, and a modified paraffin wax comprising branched isomers and linear isomers, wherein the branched isomers are present in an amount of from about 1% to about 20% of the wax and have a number average molecular weight of from about 520 to about 600, and the linear isomers are present in an amount of from about 80% to about 99% of the wax and have a number average molecular weight of from about 505 to about 530; and wherein particles comprising the toner possess a circularity of from about 0.982 to about 0.995.

10. The toner of claim 9, wherein the resin comprises a poly(styrene-butyl acrylate), the optional colorant comprises dyes, pigments, combinations of dyes, combinations of pigments, and combinations of dyes and pigments, and wherein the branched isomers in the modified paraffin wax have a weight average molecular weight of from about 530 to about 580, and the linear isomers in the modified paraffin wax have a weight average molecular weight of from about 480 to about 550.

11. The toner of claim 9, wherein the branched isomers of the modified paraffin wax have a number of carbon atoms of from about 31 to about 59, the linear isomers of the modified paraffin wax have a number of carbon atoms of from about 24 to about 54, and the toner has a size of from about 1 micron to about 20 microns, and a circularity of from about 0.982 to about 0.995.

* * * * *